US006086061A

United States Patent [19]

Vedoy et al.

[11] Patent Number: 6,086,061

[45] Date of Patent: Jul. 11, 2000

[54] AUTOMATIC PRODUCT LOADER FOR USE WITH SHEET FEEDERS

[75] Inventors: Arild Vedoy, Little Canada; Mark Nordling, Crystal; Neal F. Nordling, White Bear Lake, all of Minn.

[73] Assignee: Multifeeder Technology, Inc., White Bear Lake, Minn.

[21] Appl. No.: 09/144,062

[22] Filed: Aug. 31, 1998

[51] Int. Cl.[7] ..... B65H 5/22

[52] U.S. Cl. ..... 271/3.01; 198/810.02; 198/810.04; 198/836.1; 198/861.1; 198/586

[58] Field of Search ..... 271/3.01; 198/810.02, 198/810.04, 836.1, 861.1, 586

[56] References Cited

U.S. PATENT DOCUMENTS

| | | | |
|---|---|---|---|
| 3,193,077 | 7/1965 | Goldberg | 198/28 |
| 3,834,524 | 9/1974 | Ratz et al. | 198/232 |
| 3,982,750 | 9/1976 | Pulda | 198/373 X |
| 4,261,460 | 4/1981 | Peterson, II | 198/828 |
| 4,511,028 | 4/1985 | Meister | 198/497 |
| 4,706,799 | 11/1987 | Churchland et al. | 198/457 |
| 4,772,004 | 9/1988 | Golicz | 271/3.1 |
| 5,306,115 | 4/1994 | Montalvo et al. | 414/797.9 |
| 5,419,677 | 5/1995 | Cohn | 414/789.5 |
| 5,601,397 | 2/1997 | Lopez et al. | 414/790.7 |
| 5,720,593 | 2/1998 | Pleake | 414/789.9 |
| 5,765,678 | 6/1998 | Uranaka et al. | 198/810.01 |
| 5,915,527 | 6/1999 | Nakamura | 198/861.1 |
| 5,941,365 | 8/1999 | Ritter | 198/380 |

*Primary Examiner*—Christopher P. Ellis
*Assistant Examiner*—Richard Ridley
*Attorney, Agent, or Firm*—Nikolai, Mersereau & Dietz, P.A.

[57] ABSTRACT

An automatic product loader adapted for loading flat sheet products into a hopper of a friction sheet feeder, upon demand, and includes a frame that adjustably supports a horizontal bed that can readily be elevated and lowered as well as be longitudinally shifted in a forward and rearward direction. The bed supports the upper flight of at least one endless belt. Also supported on the bed on either side of the endless belt run are vertically extending side guide plates. The forward edges of the side guide plates are slotted so as to receive the rear edges of the side guides defining the hopper of the friction sheet feeder so that there will be no edge or shoulder at the transition on which a sheet product might catch and become skewed. Photoeyes are used to control the automatic product loaders drive motor based upon the level of sheet products in the friction feeder's hopper.

11 Claims, 7 Drawing Sheets

AUTOMATIC PRODUCT LOADER FOR USE WITH SHEET FEEDERS

BACKGROUND OF THE INVENTION

I. Field of the Invention

This invention relates generally to machines for feeding sheets one at a time from a stack of such sheets contained within a hopper, and more particularly to apparatus for automatically filling the hopper as the supply of sheets therein becomes depleted.

II. Discussion of the Prior Art

So-called friction feeders, sheet feeders and shingle feeders are known in the prior art. These machines are designed to dispense sheets from a stack of such sheets contained in a hopper, one at a time, to an output conveyor for collating and/or packaging the sheet products. When dealing with printed matter, there may be a sheet feeder for each page to be assembled into a booklet and, therefore, many such identical sheet feeders may be positioned adjacent the discharge conveyor for depositing a different sheet or page as the booklet is being assembled.

A typical sheet feeder will have an endless belt running beneath a hopper that frictionally engages the bottommost sheet in a stack of sheets in the hopper and carries it through a gap defined by a gate member, the gate member serving to hold back all but the bottommost sheet until that sheet clears the gap. For such a sheet feeder to work on a continuous basis, there is a limit to how many sheets may be contained in a stack in the hopper. The weight of the sheets in the stack is a factor in how well they can be fed without jamming. Because there is a limit to the number of sheets that may be stacked in the hopper for delivery, an individual attendant can only service a few such feeders.

Recognizing this problem and in attempting to reduce manpower costs, automatic product loaders have been developed for feeding sheets products into the hopper of the friction feeder on an "as needed" basis. The Golicz U.S. Pat. No. 4,772,004 describes a feeder mechanism in which a first endless belt conveyor is used to feed a stack of sheets onto a second endless belt disposed below the plane of the first belt. The sheets on the second belt are brought into contact with a specially designed gate structure referred to therein as a "singulator feeder assembly".

The apparatus described in the Golicz '004 suffers from several drawbacks. First, it lacks proper product guiding from the loader conveyor to the infeed conveyor such that sheets are likely to become skewed. Also, it lacks support for holding the stack of products proximate the trailing edge thereof to thereby minimize the weight of the stack on the feed belt. Without such a rear support element, proper shingling of products passing beneath the singulator does not occur, leading to unwanted multiple sheet feeds.

Disclosed in a co-pending Vedoy, et al. patent application Ser. No. 09/032,825 entitled "Sheet Feeder" and assigned to the assignee of the present invention is an electronically controlled sheet feeder having a hopper defined by front guides 28 and 30, a rear support 78 and first and second parallel spaced-apart side plates 84 and 86. (The contents of that patent application are hereby incorporated by reference as if fully set forth herein.) The present invention provides an improved automatic product loader for use with such a sheet feeder whereby a large quantity of sheet products may be continuously loaded from the automatic product loader into the hopper of the friction feeder. As such, a single attendant is readily able to maintain a supply of sheet products to be singulated on a large plurality of sheet feeder systems.

SUMMARY OF THE INVENTION

The present invention provides an automatic product loader that is adapted for loading flat sheet products into a hopper of a friction sheet feeder, upon demand. The sheet feeder is of the type having front guides and a pair of spaced-apart vertical side plates for defining a hopper in which sheet products to be singulated are inserted. The hopper is positioned above friction belts or rollers so that the bottommost sheet in a stack will be transported in a gap at a nip defined by a gate member and the friction belt or roller. The product loader itself comprises a frame supporting an elongated, generally horizontal bed at an elevation that is adjustable relative to a floor surface and to the feeder magazine level, the bed having a rear end and a forward end. A motor-driven endless belt has its upper flights supported by the bed and is adapted to move flat sheet products in a forward direction toward the hopper of the friction feeder. First and second elongated side guide members are adjustably mounted on and project upwardly from the horizontal bed on opposite sides of the endless belt. The forward edges of the side guide members are adapted to engage a rear edge of the vertical side plates of the sheet feeder hopper without creating a sheet product engaging transition.

The bed is supported on a pair of elongated, horizontal slide rails and suitable linear bearings facilitate easy movement of the bed relative to the frame to facilitate setup and access for maintenance.

Electrical control means are provided which include a means for sensing the level of flat sheet products in the hopper and for energizing the drive motor for the product loader when the level falls below a preset level. Means are also provided for signaling an operator that product on the loader is about to be exhausted so that it can be promptly refilled.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
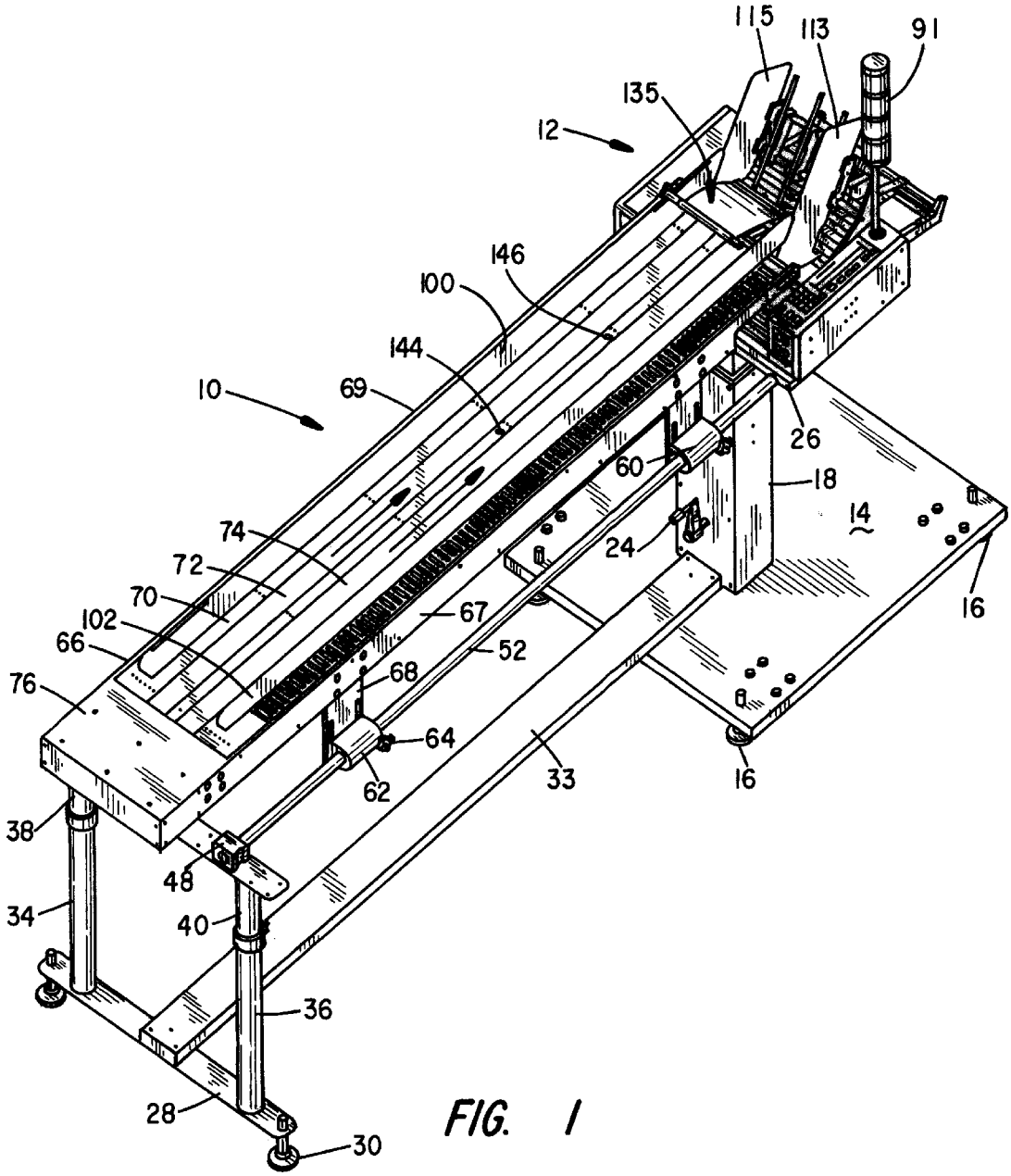
FIG. 1 is a perspective view of the automatic product loader of the present invention being used with a friction feeder product singulator.

Certain terminology will be used in the following description for convenience in reference only and will not be limiting. The words "upwardly", "downwardly", "rightwardly" and "leftwardly" will refer to directions in the drawings to which reference is made. The words "inwardly" and "outwardly" will refer to directions toward and away from, respectively, the geometric center of the device and associated parts thereof. Said terminology will include the words above specifically mentioned, derivatives thereof and words of similar import.

Referring first to FIG. 1, there is indicated generally by numeral 10 a perspective view of an automatic product loader in accordance with the present invention. It is shown as being coupled to a bottom-feeding sheet feeder 12 and is used to supply a continuous stream of sheet materials (not shown) into the input hopper of the sheet feeder 12.

As mentioned above, the automatic product loader 10 is especially adapted for use with a sheet feeder 12 that is fully described and claimed in the aforereferenced patent application Ser. No. 09/032,825. Those desiring a detailed description of the constructional features and mode of operation of the friction feeder 12 are referred to the aforereferenced Vedoy et al. application.

Focusing on the automatic product loader 10, it is seen to comprise a frame that has a generally planar base plate 14 that is mounted on jack pads 16 and caster wheels at its four corners and projecting upwardly from the base is a tubular leg 18 of rectangular cross-section and having an open upper end 20 in which a further rectangular post 22 of lesser length and width dimension is telescopingly fitted. See FIG. 2. A conventional jack screw mechanism (not shown) is provided for raising and lowering the inner member 22 upon rotation of a hand crank 24. Affixed to the upper end of the inner leg segment 22 is a mounting platform 26 that supports the friction sheet feeder 12 thereon.

The frame of the automatic product loader 10 further includes a rear horizontal cross-member 28 which rests upon a pair of jack pads 30 when it is desired to maintain the castor wheels 32 off of the floor. A longitudinal support channel or brace 33 is bolted to and extends between cross-member 28 and the base plate 14. Projecting vertically upward from the cross-member 28 are first and second tubular posts 34 and 36 and telescopingly fitted into the central opening thereof are upper post segments 38 and 40. Clamping screws having thumb knobs 42 (FIG. 2) project through the outer posts 34 and 36 to engage the inner posts 38 and 40 to maintain a desired height setting when tightened.

An upper cross plate 44 is welded or otherwise affixed to the upper ends of the post segments 38 and 40. Rear slide rail mounting blocks 46 and 48 are affixed at desired spaced-apart locations along the length of the cross plate 44 and are used to clamp slide rails 50 and 52 therein. The opposite (forward) ends of the slide rails fit into similar clamping blocks as at 54 (FIG. 2), fastened to the undersurface of the friction feeder mounting platform 26.

Cooperating with the slide rods 50 and 52 are bearing housings 56, 58, 60 and 62 which contain linear ball bearings (not shown) for facilitating smooth sliding movement of the bearing housings relative to the slide rods on which they are mounted. Quick lock handles 64 on each of the bearing housings can be used to lock the bearing housings to the slide rods at a desired longitudinal position.

Figure 2:
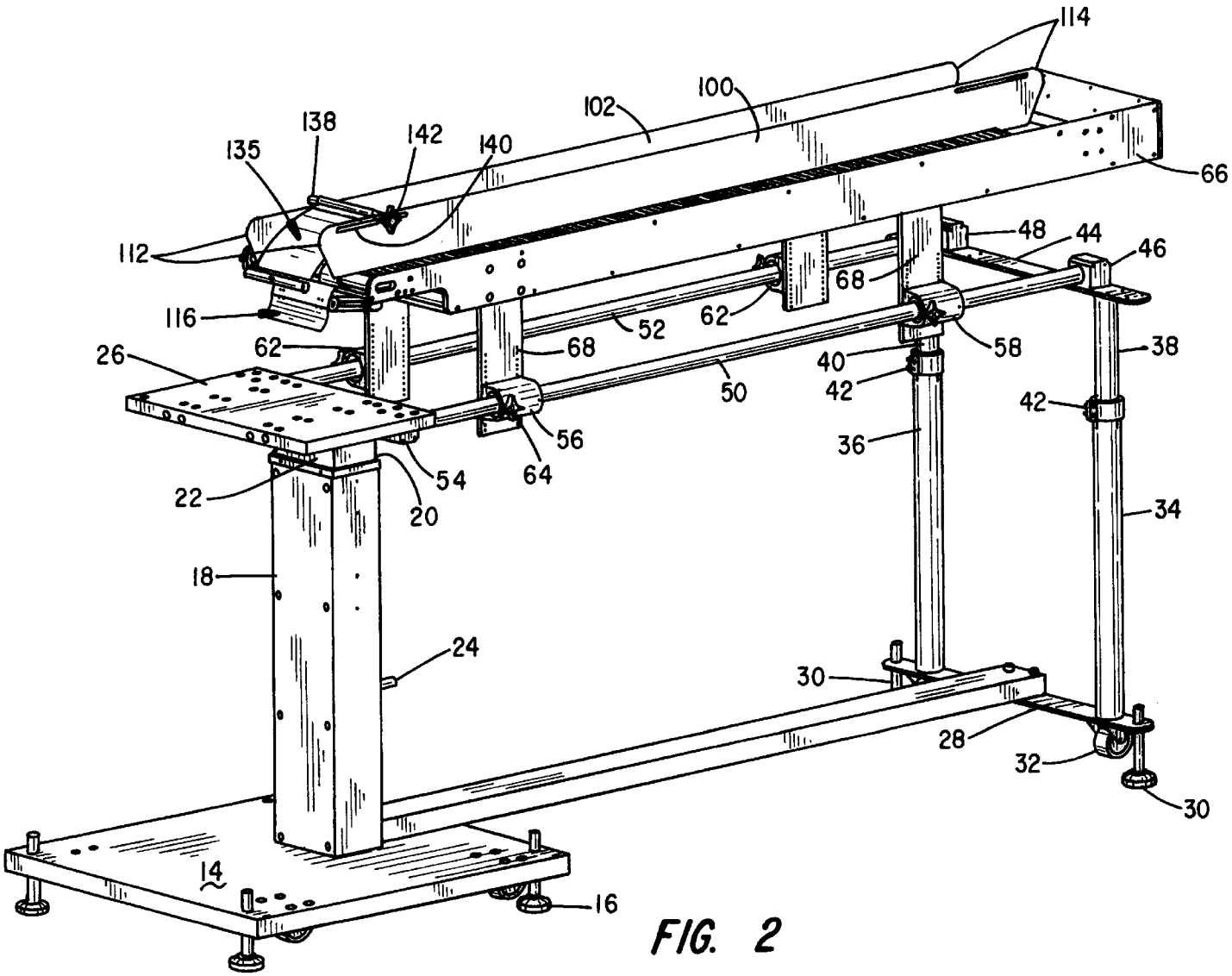
FIG. 2 is a further perspective view of the automatic product loader but with the friction feeder removed.

The bearing guides 58–62 are connected to a conveyor bed 66 by means of mounting plates 68. As seen in FIG. 2, the mounting plates 68 include a plurality of regularly spaced holes extending vertically along the side edges thereof, allowing the vertical spacing between the slide rails 50–52 and the conveyor bed 66 to be adjusted by selecting the particular holes into which mounting screws passing into the bearing guides are placed. This spacing adjustment will be dependent upon the size of the sheet products being fed into the friction feeder 12 and is effective to accurately set the height of the conveyor bed relative to the friction feeder.

Figure 3:
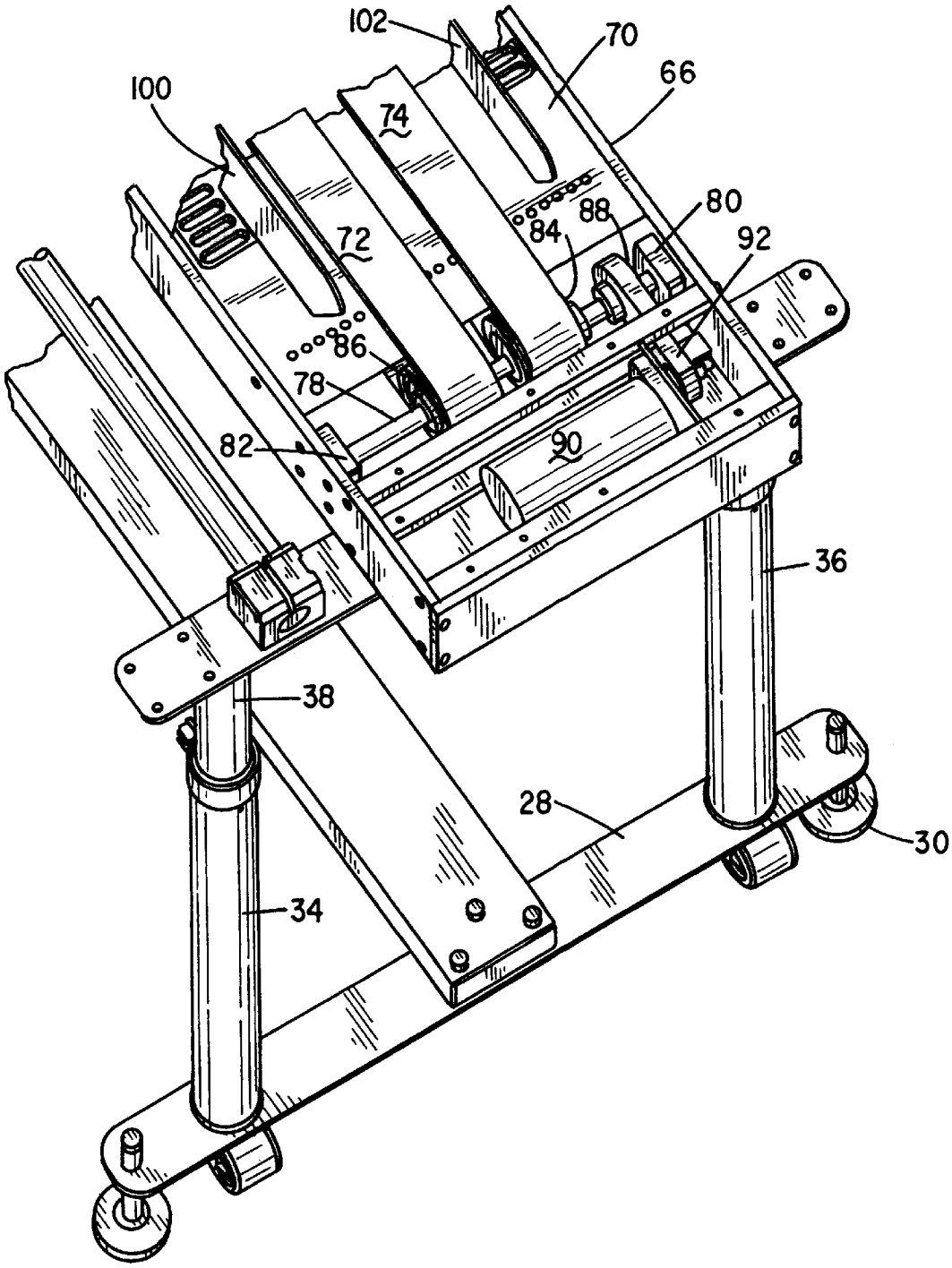
FIG. 3 is a detailed partial view of the rear end portion of the automatic product loader showing the belt drive mechanism.

The conveyor bed 66 includes a flat horizontal sheet metal plate 70 which supports the undersurface of a pair of endless belts 72 and 74 whose upper flights are driven in a direction indicated by the arrows marked on the belts in FIG. 1. The undersurface of the belts are treated to present a low coefficient of friction and textured for minimized surface contact area, but the exposed side is rubberized to afford a relatively high coefficient of friction. The belt drive system is disposed beneath the motor cover plate 76 and FIG. 3 is a partial view of the rear portion of the automatic product loader with the motor cover plate 76 removed. Contained within the drive compartment of the bed 66 is a transversely extending rotatable shaft 78 that is journaled for rotation in bearing blocks 80 and 82 fastened to the side walls of the bed 66. Mounted on the shaft 78 are first and second drive pulleys 84 and 86 and a driven pulley 88. The endless belts 72 and 74 loop about the drive pulleys as illustrated. The shaft 78 is adapted to be driven by hp electric motor 90 through in approximately 30:1 gear box which is coupled to the driven pulley 88 by means of a toothed timing belt 92 that encircles the driven pulley as well as a sprocket (not shown) connected to the motor's output shaft. The pulley ratio may be 2:1.

Figure 4:
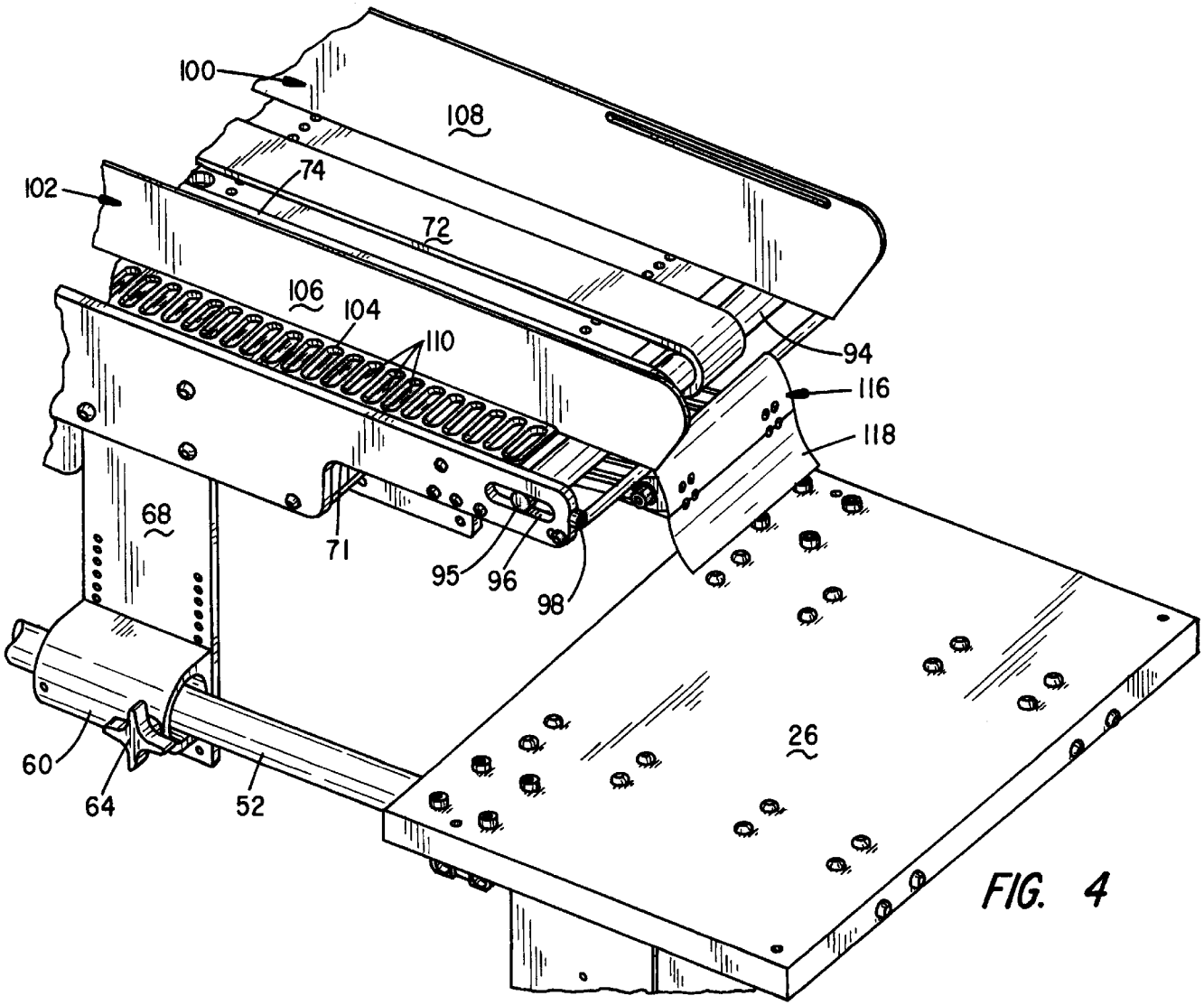
FIG. 4 is a detailed partial perspective view of the discharge end of the automatic product loader.

FIG. 4 is a partial detailed view of the forward end portion of the automatic product loader and, as seen thereon, the endless belts 72 and 74 are deployed about a nose roller 94 that is rotatably mounted onto an idler shaft 95 with its end portions extending into elongated slots 96 in the conveyor bed side walls 67 and 69. An adjustment screw 98 extends through the end of the conveyor bed's side walls on opposed ends of the idler shaft 95, allowing the tension of the belts 72 and 74 to be adjusted so as not to slip relative to the belt drive pulleys 84 and 86 when sheet products are being transported along the conveyor bed. FIG. 4 also shows that the vertical side edges 67 and 69 of the conveyor bed 66 include a rectangular cutout 71 in the forward ends thereof, the cutouts providing clearance for closely overlapping the discharge end of the product loader 10 with the sheet feeder 12. The extent of overlap is again a function of the size of the sheet products being handled.

Referring back to FIG. 1, mounted on the horizontal plate 70 of the conveyor bed 66 are side guides 100 and 102 which function to constrain flat sheet products being carried on the automatic product loader to match up with the width dimension of the friction feeder's hopper defined by the parallel, spaced-apart vertical side plates 113 and 115.

As is more clearly illustrated in the detailed view of FIG. 4, the side guides 100 and 102 of the automatic product loader each include a base 104 that extends at right angles to and projects laterally from only one side of vertically, upwardly projecting guide plates 106 and 108. The bases 104 include a plurality of elongated, regularly spaced, parallel slots 110 that have counter-sunk edges for receiving mounting screws therethrough for securing the base 104 to the horizontal bed plate 70, whereby the spacing between the guide plates 106 and 108 is continuously adjustable between a maximum and a minimum spacing. The side guides 100 and 102 can be turned end-for-end from their disposition shown in the drawings to allow for still wider sheet products. Without limitation, the slots 110 may be approximately 16 mm centers and then the threaded mounting holes in the horizontal plate 70 are spaced at predetermined multiples of 16 mm such as 18.5, 39, and 59.5, 80 which allows the side guides 100 and 102 to be continuously adjusted lengthwise of the bed in 8 mm increments.

As perhaps most clearly seen in the perspective view of FIG. 2, the leading and trailing edges 112 and 114, respectively, of the side guides 100 and 102 are inwardly and downwardly sloped at a predetermined angle conforming to the angle at which the side plates 113 and 115 of the friction feeder's hopper are slanted. Furthermore, from FIG. 5 it can be seen that the edges 112 and 114 each include a slot formed midway along their thickness dimension, such that the hopper side plates 113 and 115 can be made to fit into these slots, thereby eliminating an edge or corner at the transition that might cause the product to catch on and become skewed as it leaves the automatic product loader 10 and enters the hopper of the sheet feeder 12.

Figure 6:
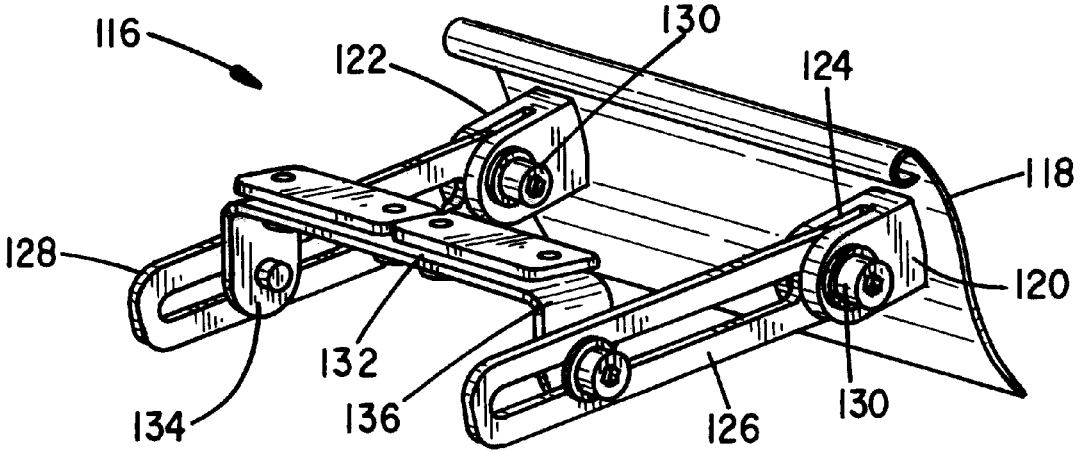
FIG. 6 is a detailed perspective view of the support curve assembly used on the automatic product loader.

To further facilitate the flow of products off the automatic product loader into the hopper of the sheet feeder, there is mounted on the underside of the bed 66, proximate the forward end thereof, a support curve member, indicated generally by numeral 116 in FIG. 2. The support curve member, itself, is shown in the perspective view of FIG. 6. It is seen to comprise a S-shaped curved plate 118 affixed by counter-sunk screws (not shown) to clevis blocks 120 and 122. Each of these blocks includes a medial slot 124 formed therein and a transversely extending bore whereby support bars 126 and 128 can be inserted into the slots 124 and clamped in place by bolts 130 passing through the bores. This connection permits the S-shaped support curve 118 to be tipped up and down to change its angulation. The assembly 116 is affixed to the underside of the bed of the product loader conveyor by a mounting bracket 132 having downwardly depending ears 134 and 136. Screws passing through the longitudinal slots in the support arms 126 and 128 permits in and out adjustment of the support curve relative to the nose roller 94. The adjustment is made at the time of setup for differing products so that sheet products leaving the automatic product loader and being deposited in the sheet feeder's hopper would be supported at their trailing edge and facilitating the shingling of the sheet products and jam-free flow through the sheet feeder.

To further enhance a water-fall type flow of flat sheet products from the automatic product loader 10 into the hopper of the sheet feeder 12, there is provided an optional product deflector assembly 135. It is deemed optional in that not all sheet products being handled require the use of a deflector. The deflector 135 comprises an elastomeric sheet having a smooth, slick surface on the underside thereof. Polypropylene, approximately 35 mils thick, is mounted on a support rod 138 having a threaded end portion passing through a longitudinal slot 140 formed in the product guide plate 100. A thumb knob 142 can be used to adjust the position of the support rod 138 relative to the length of slot 140 before being tightened to lock-in the desired setting. As seen in FIGS. 1 and 2, the flexible sheet deflector 135 is cantilevered out, over and above the nose roller 94 and curves downward so as to intersect the path of travel of product exiting the automatic product loader and steer the leading edge of the sheet products downward toward the front guides 117 forming a part of the hopper for the sheet feeder. The free end of the deflector sheet 135 may be weighted to cause it to present a desired curvature.

Figure 5:
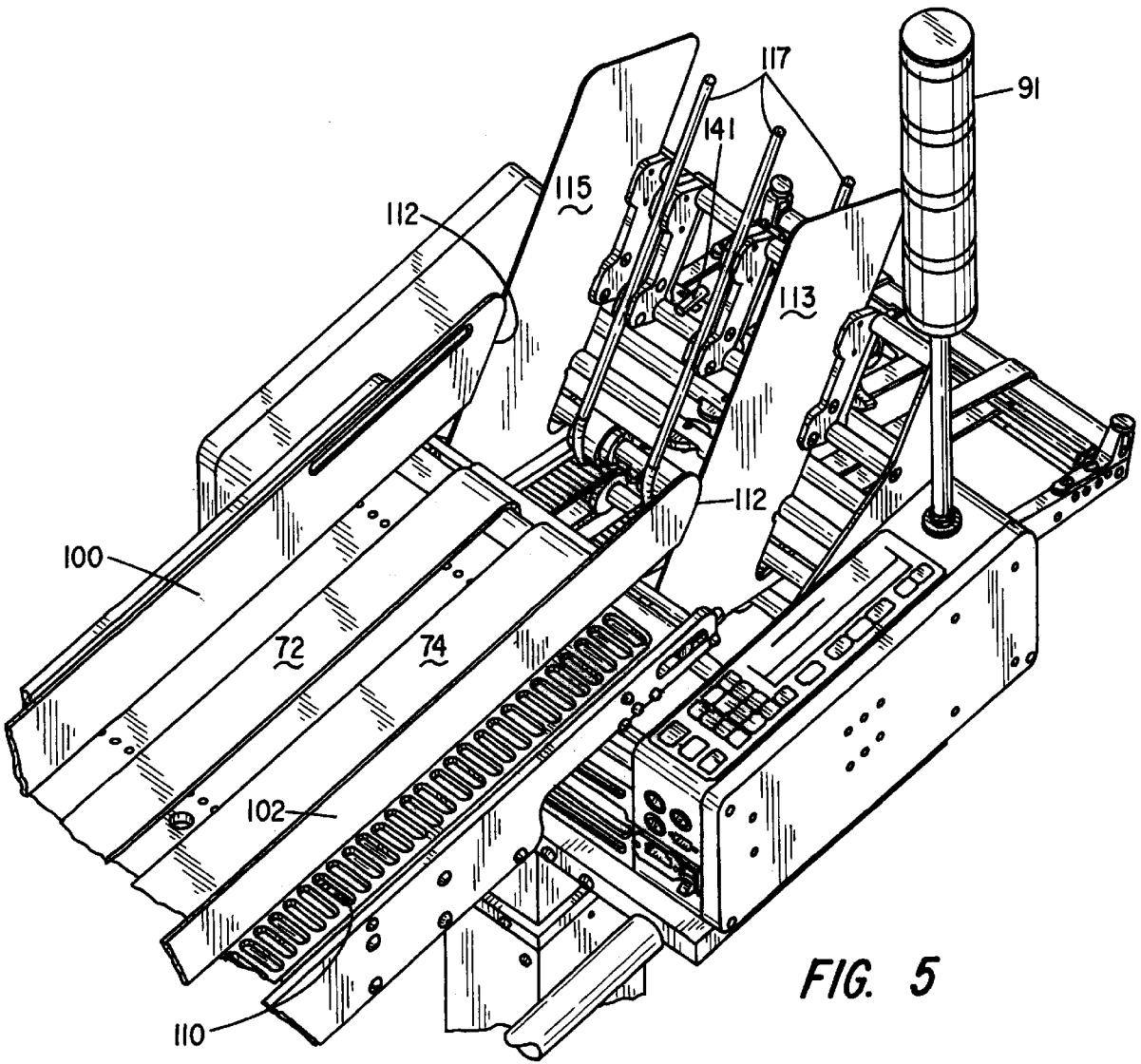
FIG. 5 is a detailed partial perspective view of the discharge end of the automatic product loader operatively coupled to the friction feeder.

Referring to FIG. 5, affixed to the sheet feeder is a photosensitive eye 141 that senses the level of sheets in the hopper and causes the motor 90 to be energized when the level of sheets in the hopper of the sheet feeder falls below a preset level to thereby turn on the product loader 10 so as to feed additional sheets into the hopper. Rather than using a photoeye to sense the level of sheets in the hopper for controlling the motor 90, it is further contemplated that the microprocessor contained within the feeder can be programmed with a product density parameter, the product density being the number of products per unit of distance. The microprocessor can then energize the motor 90 of the automatic product loader based upon a current feeding rate, thus obviating the need for a photocell sensor as at 141.

A further photoeye (not shown) is mounted beneath the bed plate 70 to project up through either aperture 144 or aperture 146 (FIG. 1) formed through the bed plate 70. As the trailing edge of a supply of sheet products traverses the aperture 144 or 146 in which the photoeye is mounted, it sends a signal to the friction feeder 12 to light an indicator on the light mast 91 to alert the operator that he has only a certain amount of time to add additional sheet products to the loader before the supply thereon is exhausted.

Figure 7:
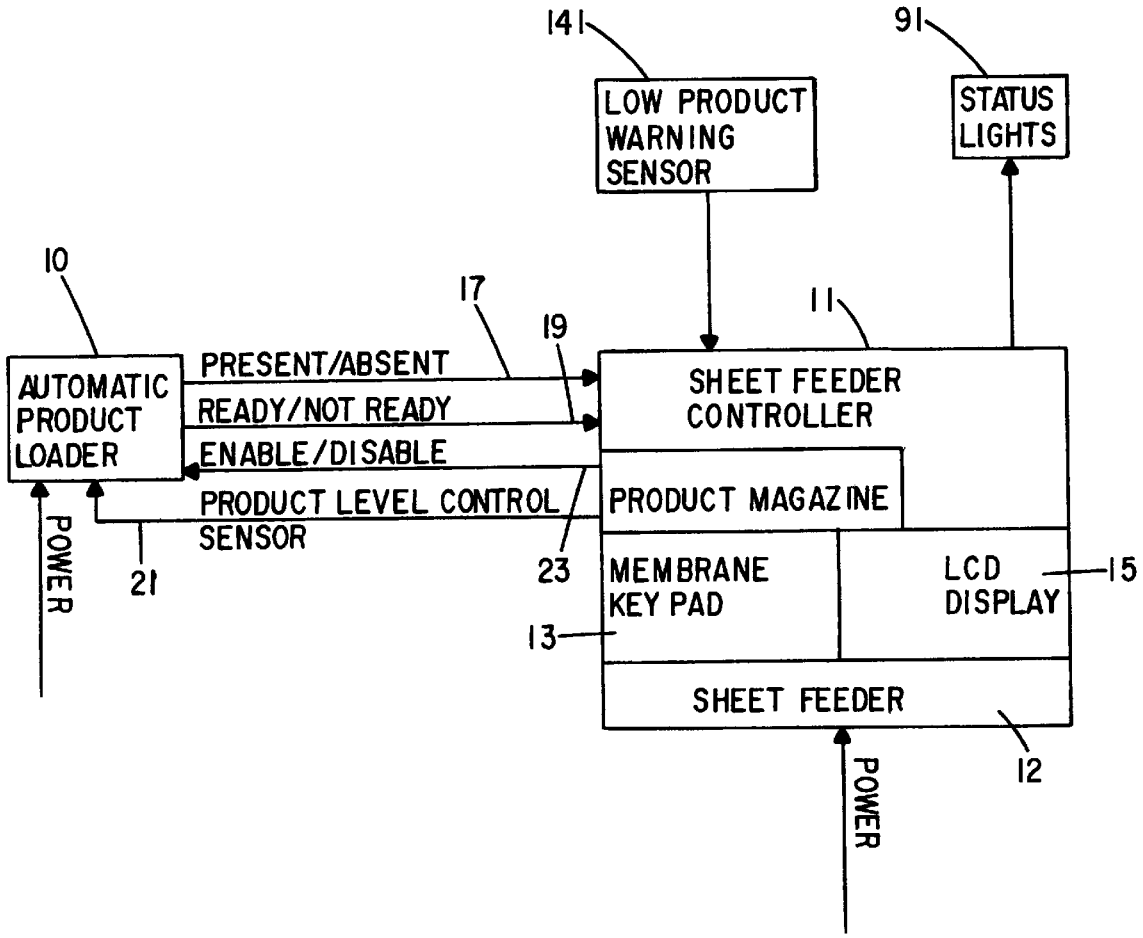
FIG. 7 is a block diagram of the electronic control for the automatic product loader.

FIG. 7 is a schematic block diagram showing the manner in which the automatic product loader 10 is controlled by a microprocessor-based controller 11 located in the sheet feeder 12. As is reflected in this schematic drawing, the sheet feeder controller module 11 functions as a "master" controller for the system and the automatic product loader 10 is a "slave". As such, the sheet feeder 12 is capable of, at all times, controlling the feeding and loading process.

Operator inputs to the sheet feeder controller 11 are provided via a membrane keypad 13 and information from the sheet feeder controller to an operator are provided via a liquid crystal display 15. The previously mentioned photoeye 141 provides a low product indication when the supply of sheet products in the feeder's product magazine or hopper fall below a predetermined level.

The automatic product loader 10 provides a signal on line 17 to indicate to the sheet feeder controller 11 whether an automatic product loader is being utilized in the system. A signal on line 19 provides ready/not ready status information to the sheet feeder controller from the automatic product loader 10. The signal on line 21 coming from the sheet feeder controller indicates to the automatic product loader that the supply of sheet products in the hopper is below the predetermined level and that the automatic product loader 10 should be turned on to supply more product to the input hopper of the sheet feeder 12. Before the motor 90 in the automatic product loader 10 can be turned on, however, an enable signal must be present on line 23 coming from the microprocessor-based controller 11 of the sheet feeder. This means, for example, that if an error condition exists at the feeder, the loader will be disabled even if the sensor calls for the loader to advance. Similarly, loading will be disabled if the operator decides to manually jog the loader. The signal on line 23 may disable the automatic product loader when a jam condition or a multiple feed condition is detected by the sheet feeder controller 11.

Having described the constructional features of the automatic product loader of the present invention, consideration will next be given to its mode of operation.

OPERATION

As is explained in the aforereferenced Vedoy et al. application, the function of the friction feeder 12 is to dispense flat sheet products one at a time from a stack of such sheets disposed within its hopper. The way in which this is accomplished is fully explained in that application and need not be repeated here. The function of the automatic product loader is to continuously supply the sheet products into the friction feeder's hopper. Assuming, strictly for the purpose of example, that the sheet products comprise 8½"× 11" paper sheets, and that they are to be fed with an 11" side leading, the operator will set the side guides 100 and 102 to a setting slightly greater than 11", and a supply of the sheets for test and setup purposes will be placed on the conveyor bed 66 atop the upper runs of the endless belts 72 and 74. A quantity of the sheets will also be directly, manually placed in the hopper of the sheet feeder and the side guides 113 and 115 thereof will be set slightly greater than 11" apart. By loosening the thumb locking screw 64 on the slide bearings 56–62, the bed with the attached side guides can be moved forward until the slots formed in the sloped end edges 112 of the side guides 100 and 102 engage the rear edges of the vertical side plates 113 and 115 comprising a portion of the hopper of the sheet feeder 12.

At this point, both the product loader 10 and the sheet feeder 12 may be placed into operation and an observation made as to how well the sheet products are being deposited into the hopper and whether they are being fed one at a time without jamming. If jamming occurs, it may often be resolved by appropriately adjusting the tilt and extension of the support curve 118 relative to the nose roller 94 of the product loader and by adjusting the deflector 136.

When a smooth uninterrupted flow of the setup sheets has been achieved, the operator may load many reams of sheets onto the bed of the conveyor and each time the level of sheets in the hopper of the sheet feeder drops below a predetermined level, the motor 90 of the automatic product loader 10 will be energized to advance the belts 72 and 74 in their forward direction, causing the sheets to flow off the end of the product loading conveyor into the friction feeder's hopper.

Depending upon the speed of operation of the sheet feeder, the automatic product loader 10 may hold a sufficient number of sheets to allow continuous operation for prolonged periods of time. Thus, a single operator can readily service many such machines by periodically placing additional reams of sheets onto the conveyor. The signaling system, including the photo sensor disposed beneath one of the apertures 144 or 146, will provide a visual and/or audible indication, via the indicator mast 91 to alert the operator that an additional supply of sheet products must be added to the conveyor bed within a certain time period if the product is not to run out.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. An automatic product loader adapted for loading flat sheet products into a hopper of a friction sheet feeder, upon demand, the sheet feeder being of the type having front guides and a pair of spaced-apart vertical side plates defining said hopper, comprising:

(a) a frame supporting an elongated, generally horizontal bed at an elevation that is adjustable relative to a floor surface, the bed having a rear end and a forward end;

(b) at least one endless belt having an upper and a lower flight, the upper flight supported by the bed and adapted to move the flat sheet products there along;

(c) means for driving the endless belt with the upper flight of the endless belt moving in a forward direction toward said hopper; and (d) first and second elongated side guide members adjustably mounted on and projecting vertically upward from the bed on opposite sides of the endless belt, each of the side guide members having a forward edge adapted to engage a rear edge of the vertical side plate of the sheet feeder without a sheet product engaging transition.

2. The automatic product loader of claim 1 wherein the frame comprises:

(a) a pair of elongated, horizontal slide rails supported at opposite ends by vertically extending legs of adjustable length;

(b) means for slidably mounting said bed to the horizontal slide rails; and (c) means cooperating with the means for mounting for releasably locking the bed at a desired location along the slide rails.

3. The automatic product loader of claim 2 wherein the vertically extending leg at a forward end of the pair of slide rails includes a platform adapted for mounting a friction sheet feeder thereon, the forward ends of the pair slide rails being affixed to an undersurface of the platform.

4. The automatic product loader of claim 1 and further including a product support plate having a predetermined curvature, the product support plate being affixed to an undersurface of the bed and being extendable, retractable and rotatable relative to said forward end of said bed.

5. The automatic product loader of claim 1 wherein the means for driving the endless belt comprises:

(a) a drive roller journaled for rotation about an axis extending transverse to a longitudinal axis of the bed and disposed proximate said rear end of the bed;

(b) a nose roller journaled for rotation about an axis parallel to the rotational axis of the belt drive roller proximate the forward end of the bed, said endless belt being deployed about the drive belt roller and the nose roller with a predetermined tension; and (c) a motor coupled in driving relation to the belt drive roller.

6. The automatic product loader of claim 5 and further including control means for sensing a level of flat sheet products in the hopper and energizing the motor when said level falls below a predetermined level.

7. The automatic product loader of claim 6 and further including sensing means disposed along the length of the bed; and signaling means coupled to the sensing means for indicating when a trailing edge of a quantity of flat sheet products carried by the endless belt reaches the sensing means.

8. The automatic product loader of claim 3 wherein the means for slidably mounting the bed includes means for independently adjusting the height of the bed relative to the mounting platform.

9. The automatic product loader of claim 1 wherein the first and second elongated side guide members each include a base extending at right angles to and projecting laterally from only one side of vertically, upward projecting sheet product guide plates, the base including a plurality of elongated, regularly spaced, parallel slots adapted to receiving mounting screws therethrough for securing the base to said bed, whereby the spacing between the first and second guide plates is continuously adjustable between a maximum and minimum spacing.

10. The automatic product loader of claim 9 wherein one of the first and second sheet product guide plates includes: an elongated, longitudinally extending slot proximate a forward edge thereof with a support rod slidably mounted within said longitudinally extending slot; and a flexible, polymeric sheet suspended along one edge thereof on the support rod, the polymeric sheet adapted to engage the flat sheet products exiting the bed of the conveyor for steering same into engagement with the front guides of the friction sheet feeder.

11. The automatic product loader of claim 6 wherein the control means further includes:

(a) means responsive to an error condition detected by the friction sheet feeder for disabling energization of the motor.

* * * * *